United States Patent [19]

Deister

[11] 4,151,959

[45] May 1, 1979

[54] APPARATUS FOR COMMINUTING PULVERIZABLE MATERIAL

[75] Inventor: Clement L. Deister, Salem, Oreg.

[73] Assignee: Clifford E. Rawlings, Missoula, Mont.

[21] Appl. No.: 873,436

[22] Filed: Jan. 30, 1978

[51] Int. Cl.[2] ..... B02C 13/06; B02C 13/28; B02C 13/286

[52] U.S. Cl. ..... 241/69; 241/186 R; 241/189 R; 241/191

[58] Field of Search ..... 241/186 R, 188 R, 189 R, 241/189 A, 275, 191, 69, 74, 294

[56] References Cited

U.S. PATENT DOCUMENTS

| | | | |
|---|---|---|---|
| 2,292,852 | 8/1942 | Werner | 241/189 R |
| 3,701,485 | 10/1972 | Kimble et al. | 241/189 R X |
| 3,834,632 | 9/1974 | Docksteader | 241/189 R X |
| 3,847,362 | 11/1974 | Lowe et al. | 241/191 |

*Primary Examiner*—Gary L. Smith
*Assistant Examiner*—Robert P. Olszewski
*Attorney, Agent, or Firm*—Klarquist, Sparkman, Campbell, Leigh, Hall & Whinston

[57] ABSTRACT

An impact pulverizer mounts a rotor concentrically within an octagonal shaped reduction chamber. The rotor has a substantially solid core and generally radially extending impact blades, each of which slopes in the axial direction of the rotor. Upon rotation of the rotor, the blades strike pulverizable material and propel the same radially of the chamber and against the interior walls thereof. The slope of the blades moves the pieces longitudinally of the chamber from the intake toward the egress end in a generally spiral rotational motion as the pieces ricochet off the interior walls and back against the rotor blades, striking each other as they so progress. The striking and ricocheting cause the pieces to break up and be reduced in size as they travel towards an outfeed opening.

12 Claims, 8 Drawing Figures

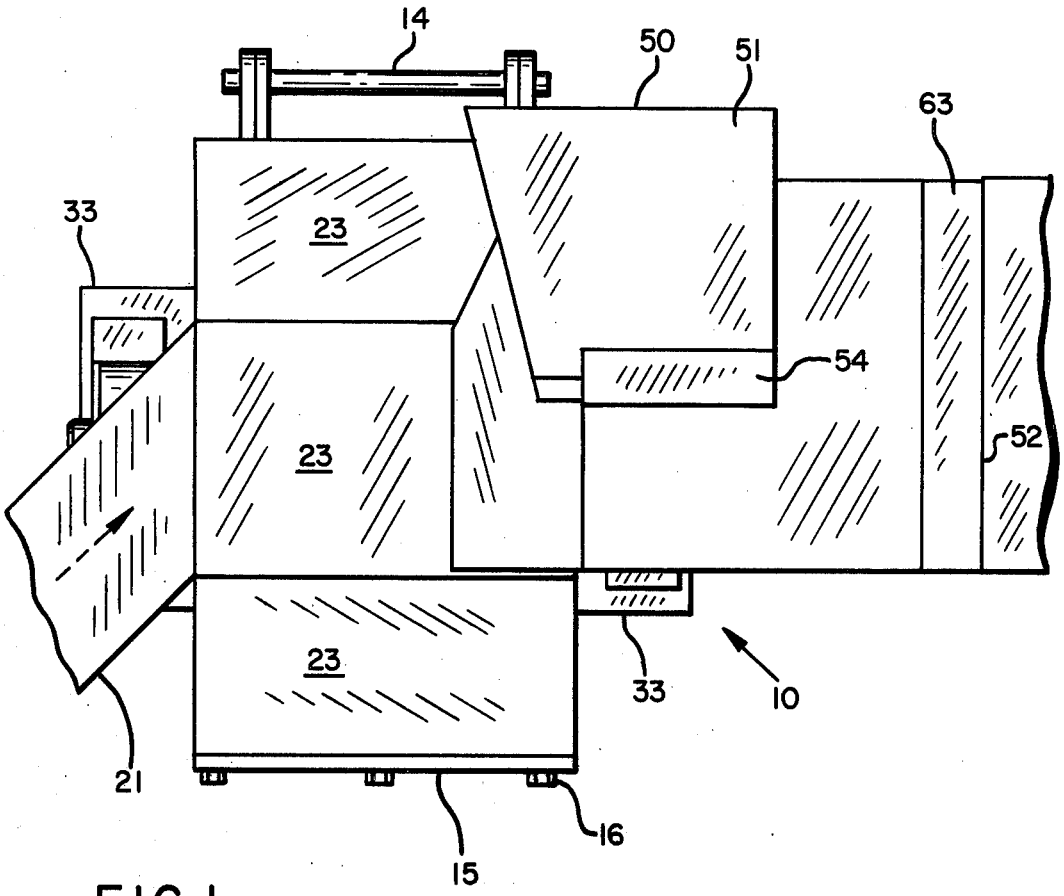
FIG. 1
FIG. 2
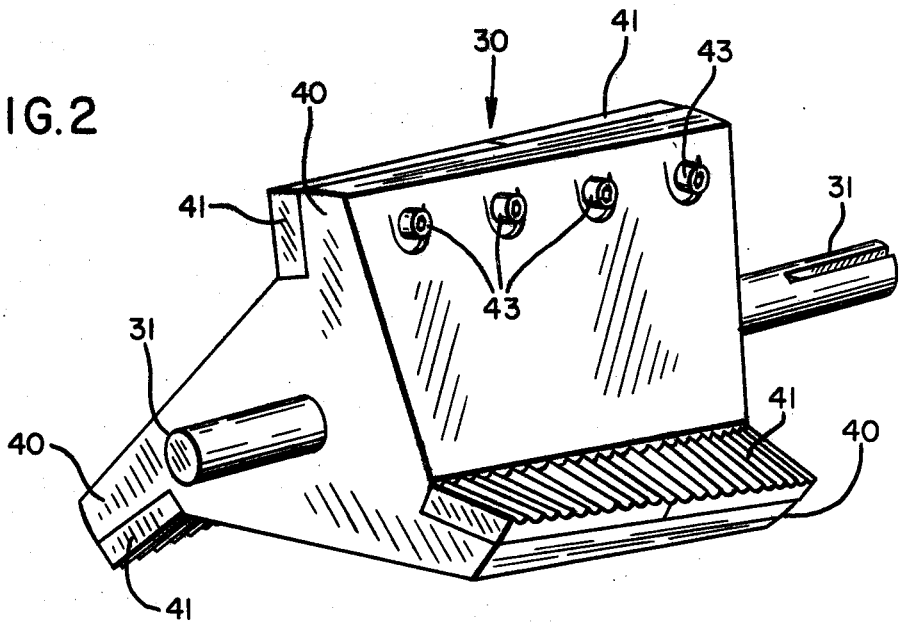

APPARATUS FOR COMMINUTING PULVERIZABLE MATERIAL

BACKGROUND OF THE INVENTION

This invention relates to impact pulverizers and, more particularly, to an impact pulverizer having an impact rotor mounted for rotation within a reduction chamber for striking pieces of pulverizable material and propelling the same radially of the chamber so that they impinge on the interior surfaces thereof.

Impact pulverizers have been known heretofore for the reduction in size of rock, metal ore and like materials. Apparatus of this type are useful in that they combine the crushing or pulverizing and classification functions in a single unit. No grinding of the material occurs, the pulverizing or attrition being caused by the particles striking impact means disposed within the interior of the apparatus and also, by the particles striking each other.

A pulverizing mill of the above-mentioned type is disclosed in Francis Pat. No. 3,887,141. This patent discloses an impact-attrition mill utilizing rotors having axially parallel impact bars for flinging ore material against axially oriented angular members depending inwardly from the walls of a primary reduction chamber within which the impact rotor is non-concentrically mounted. Ore material fed to the rotor longitudinally fully across the same is shattered by impaction against the impact bars on the rotor. After primary reduction is obtained, a secondary reduction occurs when the particles are flung into contact with other breaker bars in an axially centrally positioned secondary reduction chamber. The Francis device, however, is relatively slow acting and requires a large amount of power.

Accordingly, it is the primary purpose of the present invention to provide an impact pulverizer of the type heretofore described which acts faster and requires less power than those heretofore known.

It is a further object of the present invention to provide such an apparatus that can be used as an impact mill for a wide variety of materials, including all types of rock, ore, glass, bark and wood waste.

It is a further object of the present invention to provide an improved method of comminuting pulverizable material, which method will be faster and more efficient than those heretofore known and will require less power.

SUMMARY OF THE INVENTION

The impact pulverizer of the present invention comprises in combination with a housing and a drive motor, a reduction chamber disposed within the housing and having a polygonal-shaped interior cross-section. An infeed chute is disposed at one longitudinal end of the chamber and is adapted to feed pulverizable material to the interior thereof.

An impact rotor is operatively connected to the drive motor and is generally concentrically mounted within the reduction chamber. The rotor comprises a plurality of generally radially-extending impact blades. The radial angle of the blades increases in the axial direction of the rotor, whereby the blades are provided with a slope in such axial direction. The radial angle may increase uniformly along the length of the rotor, or it may increase in steps.

The blades are adapted, upon rotation of the rotor, to strike pulverizable material fed through the infeed chute and by virtue of the increasing radial angle, to propel such pieces radially of the chamber and against the interior walls thereof while also moving them longitudinally of the chamber from the infeed end toward the other end. The pieces of material ricochet off the interior walls of the chamber, striking each other and bounce against the rotor blades, and the action thereof results in a generally spiral rotational motion of the pieces as they traverse longitudinally through the reduction chamber towards an outfeed positioned at the end opposite the infeed end.

Optionally, a secondary reduction chamber may be disposed circumferentially adjacent the outfeed end of the first or primary reduction chamber. The secondary reduction chamber, when included, receives pieces of material propelled by the rotor blades and moved sufficiently longitudinally of the primary reduction chamber to be accessible thereto. Screen means are disposed in the secondary reduction chamber and are selected to pass only those pieces of material sufficiently reduced in size.

Optionally, the rotor blades may be serrated. In such case the serrations extend generally radially of the rotor and function to reduce the rate of axial travel of the pieces of material which in the absence of such serrations, might progress from the input end to the end adjacent the secondary chamber too quickly to achieve sufficient size reduction.

If the rotor blades are stepped, striking plates are mounted on the steps and the radial offset nature thereof interrupts the airflow, causing turbulence at the offset points and assisting in maintaining the generally spiral turbulent rotational motion of the pieces as they progress longitudinally of the reduction chamber.

The particular slope or axial increasing radial angle of the rotor blades as above-mentioned produces an initial spinning action in the pieces of comminutable material struck thereby. The creation of this spinning action increases the efficiency of the apparatus because if a piece of comminutable or pulverizable material such as metal ore, is spinning when it strikes a wear plate or another piece of material, pulverization occurs faster and more completely, thereby reducing the amount of power required to reduce the piece to a specified size.

The impact rotor is preferably solid interiorly of the impact blades, thereby to function as a flywheel, additionally to reduce the power requirements.

The apparatus further comprises air intake means disposed in the primary reduction chamber and adapted to introduce air therein beneath the impact rotor and in the circumferential direction of rotation thereof. Inducing air in such a way assists in maintaining the generally spiral rotational motion previously described and further assists in maintaining the spinning action of the individual pieces of material in the attrition chamber.

Rotation of the impact rotor assists in drawing air through the air intake means. The particular angle of the rotor impact blade surfaces assists in maintaining the spiral action of the airflow.

The secondary reduction chamber, when used, extends preferably radially of the primary reduction chamber and forwardly of the longitudinal end opposite the intake or infeed chute. Adjustable baffle means are disposed within the secondary reduction chamber. Such baffle means extend generally perpendicularly to the axis of the primary reduction chamber. The baffle means permits regulating discharge of the apparatus so as to assist in discharging pulverized material only of a desired size.

The aforementioned screen means is preferably disposed in angular relation to the baffle means. Desirably, the outer edge of the screen means is forward of the inner edge thereof. Positioning the screen means in such relation to the baffle means results in particles striking the screen means at an angle, thereby not to damage the same, but instead further achieving a cleaning action. The aforementioned angular relationship between the screen means and the baffle means makes it possible to utilize a larger mesh in the screen means than would normally be possible, thereby to produce output particles considerably smaller than the mesh openings.

The reduction chamber can also be used as a drier for wet materials when heated air is introduced through the air intake means. The combination of the spiral motion of the hot airflow together with the spiral rotational motion created by the impact blade surfaces, expose the surfaces of the pieces of material to much more hot air than if a spiral rotational motion did not exist. This greatly speeds up drying time. By changing the dimensions and configuration of the reduction chamber, materials such as wood wastes and very fine pulverized ore powders can be dried to practically zero moisture content.

BRIEF DESCRIPTION OF THE DRAWINGS

FIG. 1 is a top plan view of one embodiment of an impact pulverizer according to the present invention;

FIG. 2 is an isometric view of the impact rotor;

DESCRIPTION OF THE PREFERRED EMBODIMENT

Figure 4:
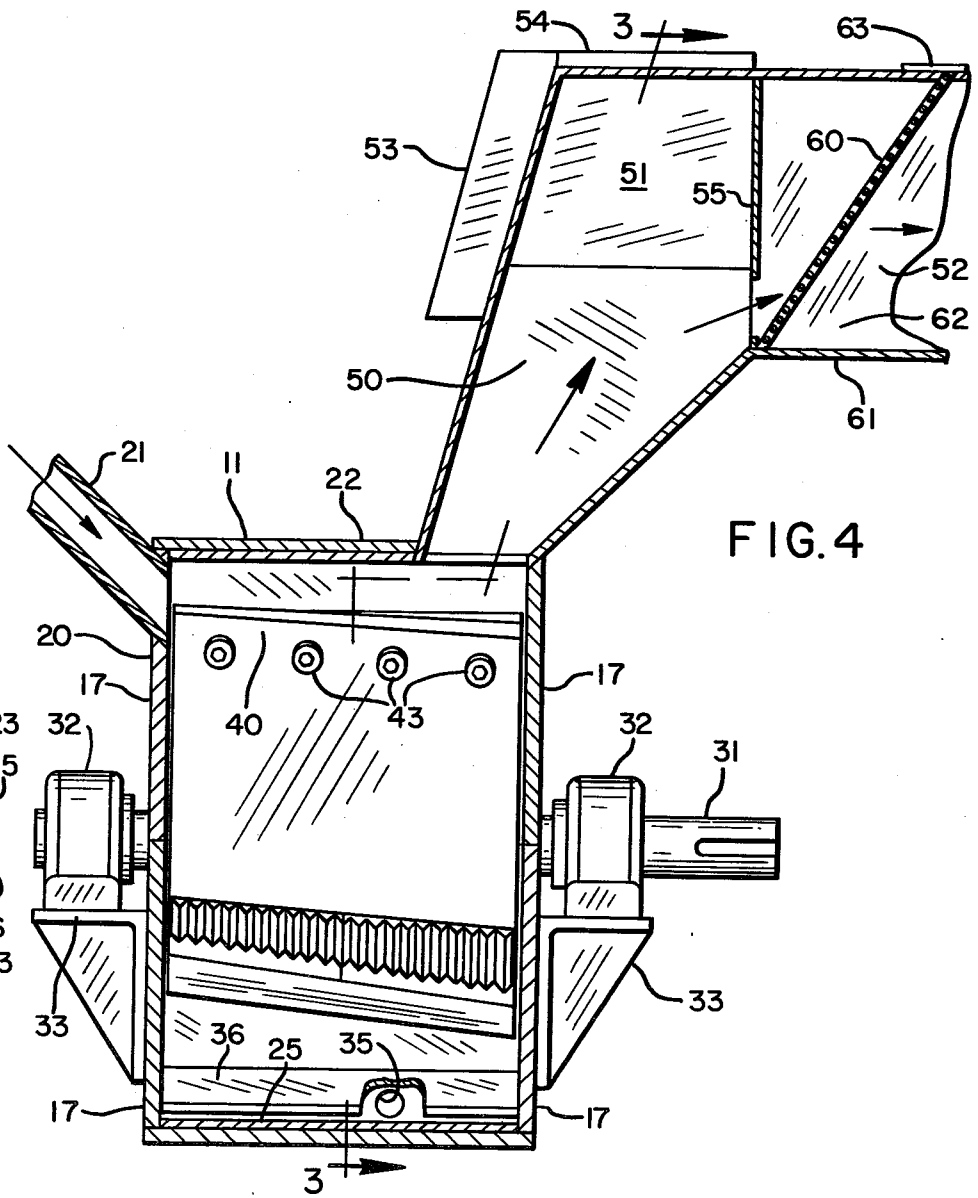
FIG. 4 is a sectional view taken on line 4—4 of FIG. 3.

Referring to the drawings and particularly to FIGS. 1, 2, 3 and 4 thereof, there is illustrated a first embodiment of the invention comprising an impact pulverizer or crusher 10 including a main housing 11 divided into two longitudinal sections 12, 13 hinged together at 14 and provided with a locking bar 15 on the opposite side secured by bolts 16. The housing 11 includes four end plates 17, on the upper one 20 of which is mounted an infeed or intake chute 21. The chute 21 is sloped forwardly and downwardly as shown for a purpose hereinafter to be described.

The circumferential periphery of the housing 11 includes a peripheral outer wall 22 formed of steel plates 23. The end plates 17 and peripheral plates 23 form a primary reduction chamber 24 having an octagonal-shaped interior cross-section lined with replaceable high-impact, abrasion resistant wear plates 25 made, for example, of "Astroloy" brand steel manufactured by Vulcan Corporation, Birmingham, Ala. I have found that the octagonal-shaped interior cross-section works very well. A hexagonal or even a square cross-section may also be used. A round cross-section would not be preferred.

A solid steel impact rotor 30 (see FIG. 2) having an axle 31 connectable to a drive motor (not shown) is mounted in bearings 32 on brackets 33 welded to the lower end plates 17.

Positioned at the bottom of the housing 11 is an air inlet 35. The number and size of air inlets will vary with the size of the pulverizer and the material being crushed thereby. Air is drawn through the inlet 35 by the action of the impact rotor as it turns at high speed. The amount of air entering is controllable by a fitting on the interior end of the inlet 35, which may also be used for introducing air into the chamber 24 from an air manifold with a single air supply, or it may be used to introduce hot air for drying the material being pulverized. The entering air is deflected to the bottom of the chamber 24 by a replaceable baffle plate 36. Air introduced through the inlet 35 keeps material off the bottom of the chamber 24, returning it to the center of chamber 24 for the pulverizing rotational motion hereinafter to be described.

Material fed to the primary reduction chamber 24 through the intake chute 21 enters the chamber 24 to be struck by the rotor 30 adjacent the intake end. The forward and downward angle at which the chute 21 is sloped feeds the material to the chamber 24 at the top of the rotor 30 and in the direction of rotation thereof. The forward angle of the chute 21 also blocks air from coming back out the chute, deflecting it back into the primary chamber 24, and this occurs for both the airflow created by rotation of the rotor 30 as well as for the air introduced through the inlet 35.

The impact rotor 30 is a feature of the present invention. As shown in FIG. 2, it is of solid steel construction so that no flywheel is required. It is assembled on a horizontal shaft 31 mounted in bearings 32, as previously stated. In the embodiment shown in FIG. 2, the rotor 30 is provided with three impact blades 40, each of which is further provided with a replaceable serrated facing plate 41 attached by bolts 43 and made of high impact, abrasion resistant material such as "Astroloy" or T-1, a high abrasion resistant material readily available. It is to be noted that the rotor 30 may include more than three blades, depending on the material to be comminuted.

The impact blades 40 and facing plates 41 extend in the generally radial direction of the chamber 24. The radial angle, however, increases in the axial direction of the rotor, such that each blade is provided with a slope of between about five degrees and fifteen degrees in the axial direction, that is, a slope of between about five degrees and fifteen degrees with respect to the shaft 31. A desirable rotation speed for the rotor 30 is such as to create a tip velocity for the plates 41 of 10,000 to 12,000 feet per minute. This causes the blades 40 to strike pieces of pulverizable material fed through the chute 21 near the intake end of the chamber 24 and propel them radially of the chamber 24 and against the plates 25. The aforementioned increasing radial angle or slope of the facing plates 41 moves the pieces longitudinally of the chamber 24 from the intake end toward the opposite end as they are given the radial propulsion. Pieces of material ricochet off the plates 25 and back against the blades 40 to be struck again, thus to be moved longitudinally of the chamber 24 in a generally spiral rotational motion which is assisted by the flow of air through the intake 35. As mentioned previously, in the embodiment shown in FIG. 2, the facing plates 41 are provided with serrations 42 which function to reduce the rate of axial travel of the pieces of material as they are flung about the interior of the chamber 24. In the absence of such serrations 42, pieces of material might progress from the intake end to the other end of the chamber more rapidly than is desirable, which in turn, might prevent sufficient size reduction. The high speed of the rotor combined with its heavy weight reduce the energy required to comminute material to a specified size.

The facing plates 41 may be turned to equalize wear, most of which occurs near the outboard edges. The plates 41 may be fabricated from a single piece of steel or they may be made in sections, depending on the material being processed and the size of the rotor.

It is to be noted that the clearance between the edges of the blades 40 and the plates 25 is generally determinative of the particulate size, a ½ inch clearance, for example, producing 1½ inch pieces of wood, yet ⅛ inch particles of coal. A larger particulate size is also obtained by reducing the speed of the rotor 30. The largest material that can be pulverized, of course, is determined by the size of the intake chute 21.

It is to be still further noted that the rotor 30 effects no grinding action, all pulverizing being done by impact between the pieces and the facing plates 41 and plates 25 and also, by impact between the propelled pieces and those ricocheting off the plates 25. It is estimated that 75% of the pulverizing action results from the pieces hitting each other. I have also found that most of the pulverization occurs at the lines of juncture of the plates 25, i.e., at the corners 27, and not at the points of minimum clearance of the rotor 30.

In the embodiment illustrated in FIGS. 1–4 a secondary reduction chamber 50 is disposed circumferentially adjacent the longitudinal end of the primary chamber 24 opposite the intake end. Pieces of material moved longitudinally of the primary chamber 24 by the propelling and ricocheting in the spiral rotational motion above-described, are propelled upwardly into the secondary chamber 50 by impact with the rotor blades 40 when they are accessible to such secondary chamber, that is when they have been worked sufficiently to the right side of the chamber (as shown in FIG. 4) to be thrown up into the secondary chamber 50 by action of the rotor 30. Pieces of material thus ejected into the secondary chamber 50 strike an upper wear plate 51 and then fall back into the primary chamber 24 striking oncoming particles, further to break up the material. As will be understood, larger particles fall down and are struck again by the rotor 30 and the entire process repeats until the pieces are pulverized sufficiently to follow the airflow upwardly and out the exit 52.

Figure 3:
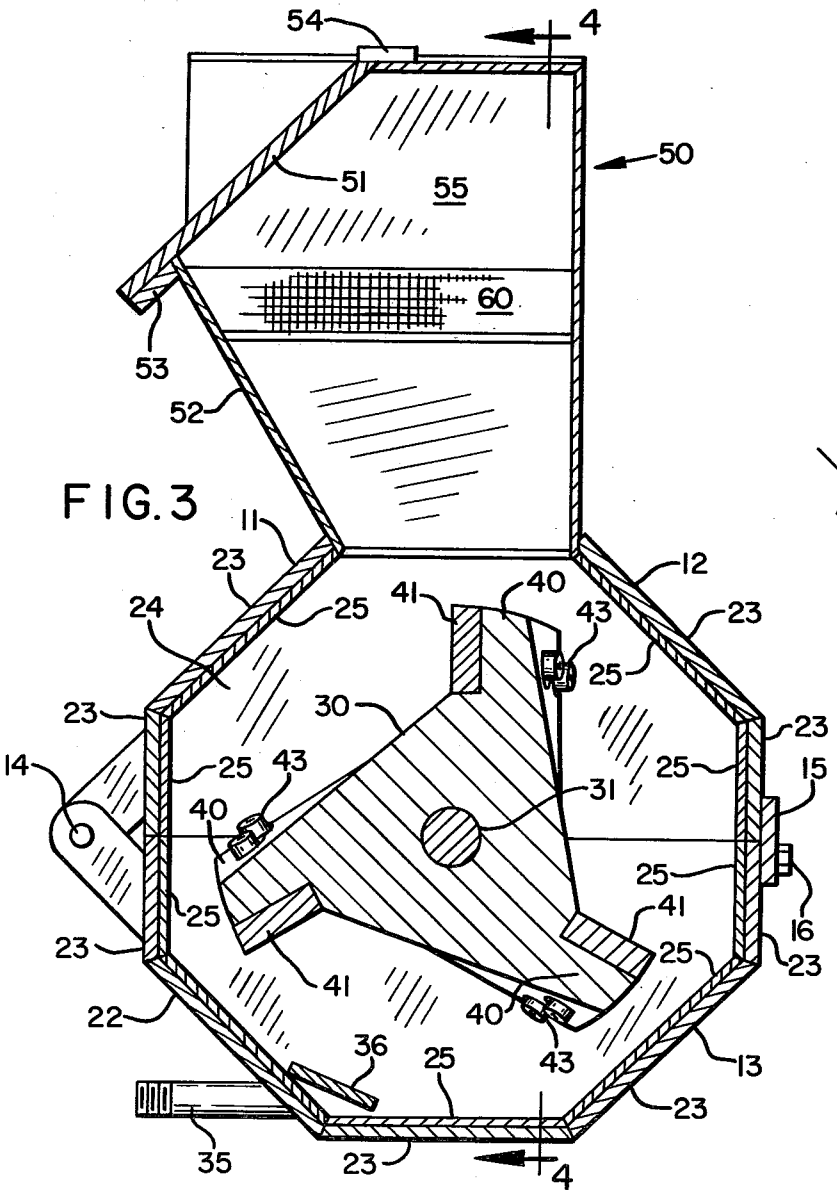
FIG. 3 is a sectional view taken on line 3—3 of FIG 4.
Figure 5:
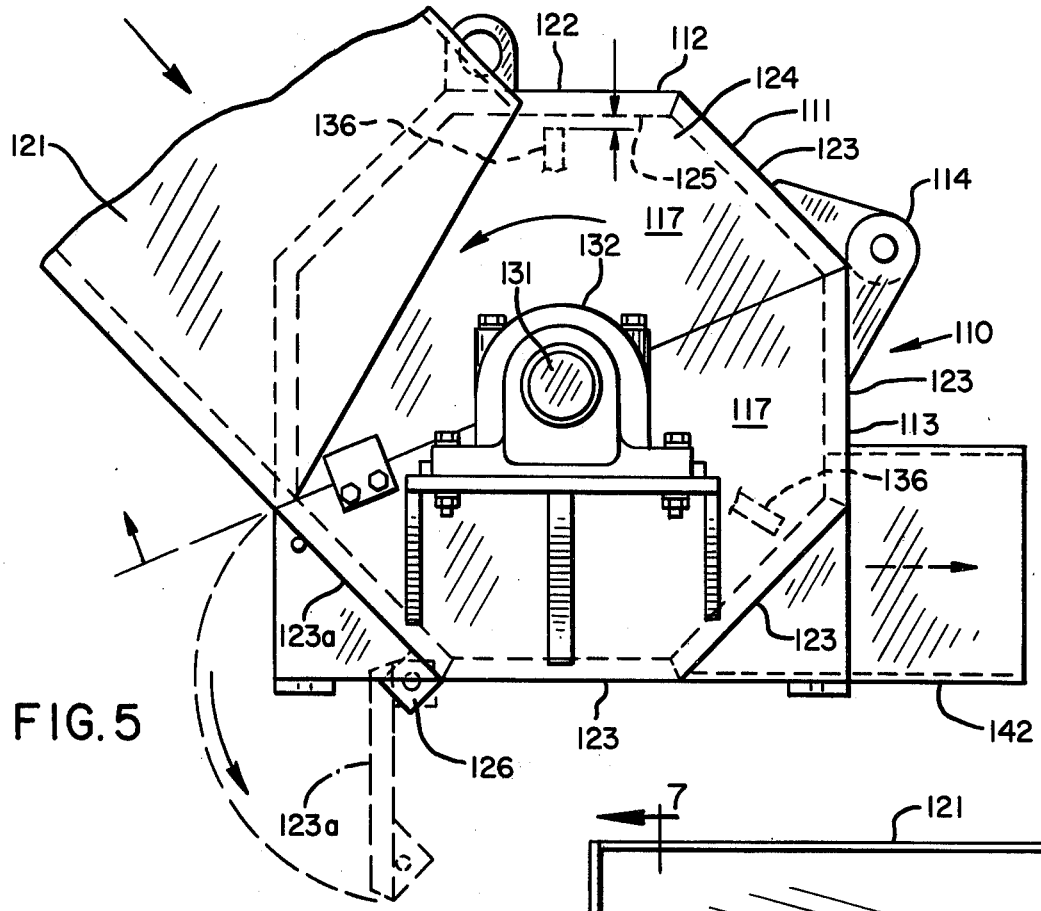
FIG 5 is an end elevational view of another embodiment of the invention.
Figure 6:
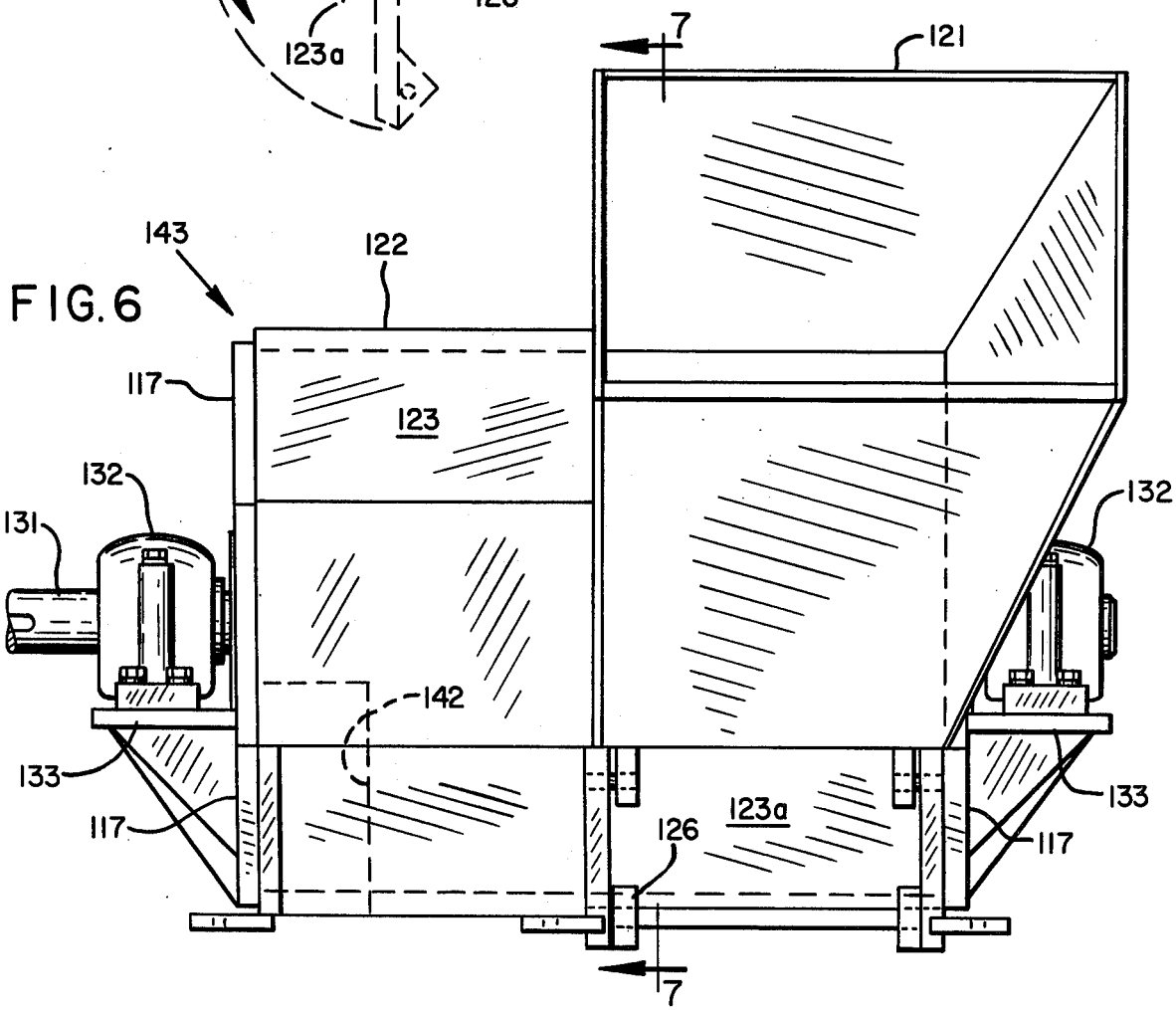
FIG. 6 is a side view of the embodiment shown in FIG. 5.

As illustrated in FIGS. 3 and 4, the secondary chamber 50 is mounted on top of the primary reduction chamber 24 and extends radially outwardly and forwardly of such chamber, as shown. It includes a supporting plate 52 which with plates 53 and 54 support the plate 51. An adjustable baffle plate 55 is positioned within the chamber 50 perpendicularly to the axis of the rotor 30, as shown. Plate 55 permits regulation of the desired size of the pulverized material. Appropriate selection of the baffle plate 55 controls and regulates the size of material which can escape from the secondary chamber 50.

Positioned forwardly of the baffle plate 55 is a classification screen 60 which is retained between plate 54 and a lower exit chamber plate 61 in an exit chamber 62 by a retainer plate 63. Chamber 62 may be modified as desired for additional drying of the pulverized material as required by the type of material being processed. Particles of the desired size will pass through the screen 60. Particles larger than desired will impinge upon the screen 60 and will fall back into the chambers 50 and 24 for additional striking, propelling, ricocheting and size reduction. The angular relation between the screen 60 and the baffle plate 55 permits a larger mesh screen to be used than would be the case if the screen were disposed at a greater angle with respect to the upward flow of air as, for example, perpendicularly thereto. In this manner a relatively large mesh screen can be used to produce particles much smaller than the openings in the screen. Positioning the screen at the relatively slight angle with respect to the upward flow also permits large particles to strike the screen at an angle, thereby not to damage it but instead, to achieve further cleaning action. (For example, the wear on screen 60 is so slight, that is can be made of aluminum window screen material even when running hard river gravel through the apparatus). Pulverized material passing through the screen 60 and entering the exit chamber 62 then proceeds into a closed circuit system, a bagging operation, a slurry operation, a flotation process or to a burning process.

In operation, material is introduced into the apparatus through the intake chute 21, striking the rapidly rotating rotor 30 adjacent the intake end. Pieces of material thus introduced essentially centrally of the primary reduction chamber 24 are struck by the rotor blades 40 which causes them to spin and to be propelled radially and slightly longitudinally of the chamber 24 so that they impinge on the plates 25 which form the octagonal-shaped interior cross-section of the chamber 24. The pieces of material ricochet off the plates 25 and strike each other, the ricocheting returning the pieces generally centrally of the chamber for additional striking and radial propulsion. The striking, propulsion and ricocheting action provide the pieces with a generally spiral rotational motion, moving them from the intake end of the chamber 24 to a position accessible to the secondary chamber 50, whereby striking by the rotor 30 impels the pieces into the chamber 50. Pieces of excessive size are blocked by the baffle plate 55, thus to have their passage through the chamber 50 impeded, and these pieces fall back into the primary chamber 24 for additional striking, propelling and ricocheting. Returned pieces are ejected with other pieces into the chamber 50.

Pieces of material of an appropriate size are carried by the airflow through the opening at the bottom of the baffle plate 55 toward the screen 60 and impinge thereon at an acute angle. Pieces failing to pass through the screen 60 fall back into the chamber 50 and thence into the chamber 24, impinging on other pieces being ejected therethrough and being reduced further in size. The action of the air through the intake 35 is thus seen not only to assist in maintaining the generally spiral rotational motion of the particles as they work their way through the primary reduction chamber 24, but also is used to carry particles reduced to the desired size upwardly through the secondary reduction chamber 50, through the screen 60, into the exit chamber 62 and out the exit 52.

The pulverizer of the instant invention can reduce ores to 300 mesh without the necessity of using a primary crusher. The spiral rotational action of the pieces as they are propelled and ricocheted around the primary reduction chamber 24 achieves a much faster pulverizing action than has been heretofore obtainable in apparatus heretofore known. The spiral rotational action further requires less power to accomplish a given result than has heretofore been required.

An impact pulverizer according to the present invention may be made with a rotor length as small as twelve inches and with an eight inch overall diameter. Such an apparatus can be carried in the back of a pickup truck. When made in larger sizes, the apparatus can be used to pulverize ground for seeding, thus to take care of a farmer's rock problem. When made in such a large size, soil and objectionable materials therein can be scraped from an eight foot wide swath, fed to the pulverizer, thereby to eliminate plowing, discing and harrowing. With the addition of fertilizer materials, the pulverized effluent achieves soil completely ready for planting in one pass of the apparatus.

The increasing radial angle which results in the axial slope of the blades 40 at the aforementioned five degrees to fifteen degrees angle with respect to the shaft 31, that is, the aforementioned slope in the longitudinal direction of the rotor, is a primary feature of the invention, impelling the material against the polygonal-shaped interior cross-section of the primary reduction chamber 24 such that as the material ricochets off the interior walls and back against the rotor blades 40, the heretofore described spiral rotational motion in the longitudinal direction of the apparatus is achieved. It is this motion of the material through the primary reduction chamber which permits the very effective pulverizing action to occur.

The secondary reduction chamber 50 also achieves a considerable portion of the pulverizing activity. Material flung into such chamber 50 impinges on the plate 51, ricocheting off and back into the chamber to collide with oppositely directed pieces. This achieves further breakup. Adjusting the size of the baffle 55 further limits the size of the particles that can pass thereunder to a size that has a reasonable chance of being ejected through the screen 60. Material which has been sufficiently reduced in size to be carried upwardly with the airflow underneath the baffle plate 55, impinges on the screen 60 and if of sufficiently reduced size, passes therethrough. If the particles are too large to pass through, the small angle of incidence between the path of the particles and the slope of the screen 60, prevents damage to the screen and permits use of a larger mesh than would otherwise be the case. The only material that passes through the screen is that of the desired size.

It is thus apparent that the invention provides an impact pulverizer or crusher which can be used as an impact mill for all types of rock, ore, glass, bark or other wood waste. If used in conjunction with heated air, drying can also be achieved during the pulverizing cycle. For example, the apparatus can be used to reduce bark to 50 mesh and with hot air, can be used also to dry the same as required.

In FIGS. 5, 6, 7 and 8 there is illustrated another embodiment of the present invention particularly adapted for use with waste wood. Thus, the pulverizer or crusher 110 includes a main housing 111 divided into two longitudinal sections 112 and 113 hinged together at 114. The housing 111 includes four end plates 117 and a peripheral outer wall 122 formed of steel plates 123. The end plates 117 and peripheral plates 123 form a reduction chamber 124 having an octagonal-shaped interior cross-section lined with replaceable high-impact, abrasion resistant wear plates 125, made as described in the embodiment of FIGS. 1–4. One of the peripheral plates **123*a* is hinged at 126** to provide a safety or blow-out door, as shown.

A solid steel impact rotor 130 (see FIGS. 7 and 8) having an axle 131 connectable to a drive motor (not shown) is mounted in bearings 132 on brackets 133 attached to the lower end plates 117.

An infeed or intake chute 121 is mounted at one end of the pulverizer 110. Material fed through the intake chute 121 enters the chamber 124 to be struck by the rotor 130 adjacent the intake end. As in the embodiment illustrated in FIGS. 1–4, the forward and downward angle at which the chute 121 is sloped, feeds the material to the chamber 124 at the top of the rotor 130 and in the direction of rotation thereof.

Figure 7:
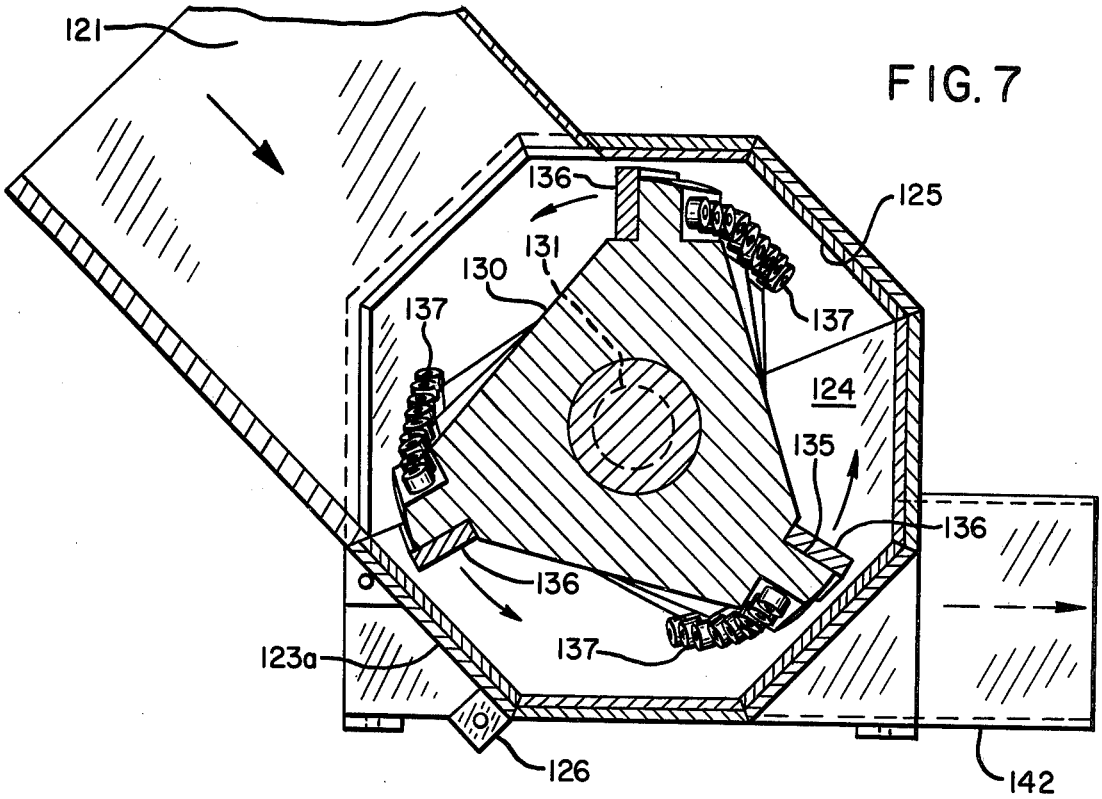
FIG. 7 is a sectional view taken on line 7—7 of FIG. 6.
Figure 8:
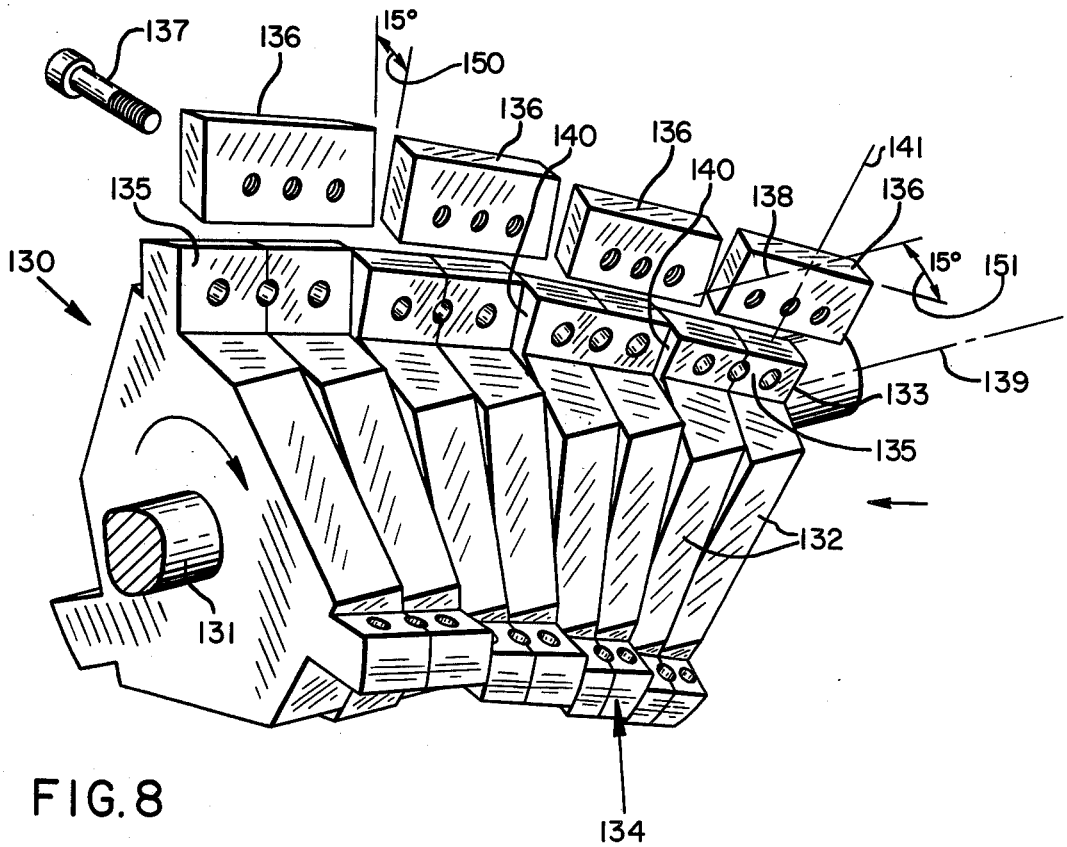
FIG. 8 is an isometric view of the impact rotor of this other embodiment.

The rotor 130 is constructed of solid steel so that no flywheel is required. It is assembled on a horizontal shaft 131 and mounted in bearings 132, as previously stated. As illustrated in FIGS. 7 and 8, it comprises a plurality of axially contiguous sections 132 which are joined together in pairs. The sections 132 are designed so that each pair provides a generally radially extending seat portion 133 for an impact blade 134, each of the sections 132 being disposed at an increasing radial angle in the axial direction of the rotor. Each pair of sections 132 is formed so that their respective portions 133 provide a generally radial, planar seating surface 135, the four surfaces 135 illustrated being themselves disposed at increasing radial angles in the axial direction of the rotor. The net effect is to create a blade having a stepped surface, the radial angle of each of the steps increasing along the rotor axis. A preferred increment of radial increase between surfaces 135 is fifteen degrees, as shown at 150 in FIG. 8. A replaceable striking plate 136 is attached to each surface 135 by bolts 137. The surfaces 135 are formed so that each plate 136 is canted fifteen degrees with respect to a line 138 parallel to the rotor axis 139, whereby only the centerline 141 is truly radial. This is shown at 151 in FIG. 8.

As in the embodiment shown in FIGS. 1–4, the plates 136 strike pieces of pulverizable material fed through the chute 121 and propel them radially of the chamber 124 and against the plates 125, the increasing radial angle or slope of the plates 136 moving the pieces longitudinally of the chamber from the intake end to the opposite end as they are given the radial propulsion.

I have found that stepping the radial angles of the plates 136 has an additional beneficial effect besides that of causing longitudinal movement of the pieces. Offsetting the plates 136 radially interrupts the smooth flow of air and causes turbulence to occur at the offset points 140. This serves to reduce the rate of axial travel of the pieces of material through the pulverizer, thereby to improve the action thereof.

The embodiment shown in FIGS. 5–8 has no secondary reduction chamber. After the pieces of material have been flung radially about the chamber 124 and moved sufficiently axially thereof, they are discharged through an outfeed 142 placed at the axial end 143 of the pulverizer remote from the infeed chute 121 and which outfeed 142 communicates with the interior of chamber 124 as shown.

I claim:

1. An impact pulverizer for comminuting materials comprising:

a housing;

a drive motor mounted in operative relation to said housing;

a reduction chamber disposed within said housing, said chamber having a polygonal-shaped interior cross-section;

infeed means disposed at one longitudinal end of said reduction chamber and adapted to feed pulverizable material to the interior thereof;

an impact rotor operatively connected to said drive motor and generally concentrically mounted within said reduction chamber, said rotor comprising a plurality of generally radially-extending impact blades, the radial angle of said blades increasing along the axis of the rotor to provide each of said blades with a slope in the axial direction of said rotor, said blades being adapted, upon rotation of said rotor, to strike pulverizable material and propel pieces thereof radially of said reduction chamber and against the interior walls thereof, said increasing radial angle of said blades moving said pieces longitudinally of said chamber from said one longitudinal end toward the other longitudinal end thereof in a generally spiral rotational motion as said pieces of said material ricochet off said interior walls and back against said rotor blades; and egress means disposed at said other longitudinal end and adapted to discharge said pieces of material from said pulverizer after they have been reduced to a predetermined size.

2. The impact pulverizer of claim 1, in which said rotor blades comprise serrated blades, said serrations extending generally radially of said rotor.

3. The impact pulverizer of claim 1, in which said rotor blades are radially stepped in the axial direction of said rotor.

4. The impact pulverizer of claim 1, in which said rotor comprises a solid rotor.

5. The impact pulverizer of claim 1 further comprising a secondary reduction chamber disposed circumferentially adjacent said other longitudinal end of the first-mentioned reduction chamber and adapted to receive said pieces of said material propelled by said rotor blades and moved sufficiently longitudinally of said primary reduction chamber to be accessible to said secondary reduction chamber.

6. The impact pulverizer of claim 5, in which said secondary reduction chamber extends radially of said first-mentioned reduction chamber and forwardly of said other longitudinal end thereof.

7. The impact pulverizer of claim 5 further comprising baffle means disposed within said secondary reduction chamber, said baffle means extending generally perpendicular to the axis of said first-mentioned reduction chamber.

8. The impact pulverizer of claim 7 further comprising screen means disposed in said secondary reduction chamber and selected to pass only pieces of material sufficiently reduced in size.

9. The impact pulverizer of claim 8, in which said screen means is disposed at an angle to said baffle means, said angle being selected whereby discharging pieces of material impinge upon said screen means at a slight angle.

10. The impact pulverizer of claim 8, in which the outer edge of said screen means is forward of the inner edge thereof.

11. The impact pulverizer of claim 1, further comprising air intake means disposed in said reduction chamber, said air intake means being adapted to introduce air into said chamber beneath said impact rotor and in the circumferential direction of rotation thereof.

12. The impact pulverizer of claim 11, further comprising baffle means disposed adjacent the discharge end of said air intake means and adapted to deflect air adjacent said interior walls of said reduction chamber.

* * * * *